US010115351B2

(12) United States Patent
Kim

(10) Patent No.: US 10,115,351 B2
(45) Date of Patent: Oct. 30, 2018

(54) LIGHT EMITTING ELEMENT DISPLAY DEVICE AND METHOD FOR DRIVING THE SAME

(71) Applicant: SAMSUNG DISPLAY CO., LTD., Yongin, Gyeonggi-Do (KR)

(72) Inventor: Yang Wan Kim, Hwaseong-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 429 days.

(21) Appl. No.: 14/657,169

(22) Filed: Mar. 13, 2015

(65) Prior Publication Data

US 2016/0019842 A1 Jan. 21, 2016

(30) Foreign Application Priority Data

Jul. 17, 2014 (KR) ..... 10-2014-0090557

(51) Int. Cl.
*G09G 3/3291* (2016.01)

(52) U.S. Cl.
CPC ... *G09G 3/3291* (2013.01); *G09G 2300/0861* (2013.01); *G09G 2310/0262* (2013.01); *G09G 2310/0297* (2013.01)

(58) Field of Classification Search
CPC ..... G09G 3/3291; G09G 2310/0262; G09G 2300/0861; G09G 2310/0297
See application file for complete search history.

(56) References Cited

U.S. PATENT DOCUMENTS

2001/0050665 A1* 12/2001 Yeo ..... G09G 3/3688 345/87
2007/0040764 A1* 2/2007 Kim ..... G09G 3/3291 345/30
2007/0132683 A1* 6/2007 Kong ..... G09G 3/2092 345/87
2008/0036704 A1* 2/2008 Kim ..... G09G 3/3233 345/76
2008/0055304 A1* 3/2008 Ryu ..... G09G 3/2022 345/214
2009/0002280 A1* 1/2009 Kim ..... G09G 3/3233 345/76
2011/0164015 A1 7/2011 Kim
2012/0313903 A1 12/2012 Pyon et al.
(Continued)

FOREIGN PATENT DOCUMENTS

KR 10-2008-0113981 12/2008
KR 10-2011-0080255 7/2011
(Continued)

*Primary Examiner* — Temesghen Ghebretinsae
*Assistant Examiner* — Ivelisse Martinez Quiles
(74) *Attorney, Agent, or Firm* — Lee & Morse, P.C.

(57) ABSTRACT

A display device includes a data driver and a demultiplexer. The data driver supplies an image data signal to the demultiplexer. The demultiplexer timely divides the image data signal and outputs the divided image data signal to a data line. The demultiplexer supplies the image data signal to a first pixel column, and supplies the image data signal to a second pixel column after a predetermined time elapses, during a first frame period. The demultiplexer supplies the image data signal to the second pixel column, and supplies the image data signal to the first pixel column after a predetermined time elapses, during a second frame period.

19 Claims, 14 Drawing Sheets

(56) References Cited

U.S. PATENT DOCUMENTS

| | | | | |
|---|---|---|---|---|
| 2013/0241900 | A1* | 9/2013 | Ge | G09G 3/006 345/204 |
| 2014/0198135 | A1* | 7/2014 | Eom et al. | G09G 3/3208 345/82 |

FOREIGN PATENT DOCUMENTS

| | | |
|---|---|---|
| KR | 10-2012-0075828 | 7/2012 |
| KR | 10-2012-0136744 | 12/2012 |

* cited by examiner

2nd FRAME PERIOD

LIGHT EMITTING ELEMENT DISPLAY DEVICE AND METHOD FOR DRIVING THE SAME

CROSS-REFERENCE TO RELATED APPLICATION

Korean Patent Application No. 10-2014-0090557, filed on Jul. 17, 2014, and entitled: "Light Emitting Element Display Device and Method for Driving the Same," is incorporated by reference herein in its entirety.

BACKGROUND

1. Field

One or more embodiments described herein relate to a light emitting element display device and a method for driving a light emitting element display device.

2. Description of the Related Art

Display devices which use light-emitting elements to generate images include compensation circuits to reduce deviation of driving current between pixels. When such a display device uses a related-art demultiplexer, image quality may deteriorate due to the compensation circuits.

SUMMARY

In accordance with one or more embodiments, a display device includes a display panel; a plurality of pixel columns on the display panel, each of the pixel columns including at least one pixel; a scan line coupled to the at least one pixel; a data line coupled to the at least one pixel; a demultiplexer to timely divide an image data signal based on control signals and to output the divided image data signal to the data line; and a data driver to supply the image data signal to the demultiplexer, wherein the demultiplexer is to supply the image data signal to a first pixel column, and is to supply the image data signal to a second pixel column after a predetermined time elapses, during a first frame period, and is to supply the image data signal to the second pixel column, and is to supply the image data signal to the first pixel column after a predetermined time elapses, during a second frame period.

The display device may include a controller to supply control signals which determine an order of driving the pixel columns. The controller may change the control signals with respect to the respective frame periods. The first frame period may be a 2p−1th frame period, and the second frame period may be a 2pth frame period.

The demultiplexer may timely divide image data signals of a same color. The demultiplexer may timely divide image data signals and may supply the divided image data signals to data lines connected to pixels of a same color.

The first frame period may include at least two horizontal periods, and the demultiplexer may supply the image data signal to a pixel of the first pixel column, and may supply the image data signal to a pixel of the second pixel column after a predetermined time elapses, during a first horizontal period, and may supply the image data signal to the pixel of the second pixel column, and may supply the image data signal to the pixel of the first pixel column after a predetermined time elapses, during a second horizontal period. The first horizontal period may be a 2q−1th horizontal period, and the second horizontal period may be a 2qth horizontal period. A control signal output last during the 2q−1th horizontal period may be continuous with a control signal output first during the 2qth horizontal period.

The display device may include a data modulator to compensate for an input image data signal and to output the image data signal. The at least one pixel may include a light-emitting element; a driving switching element to be controlled by a signal of a first node and connected between a second node and a third node; an initiating switching element to be controlled by an n−1th scan signal supplied from an n−1th scan line and connected between the first node and an initiating power line; a compensating switching element to be controlled by an nth scan signal supplied from an nth scan line and connected between the first node and the third node; a data switching element to be controlled by the nth scan signal supplied from the nth scan line and connected between a corresponding data line and the second node; a static power switching element to be controlled by an nth light-emission signal supplied from an nth light-emission line and connected between the second node and a first driving power line; a light-emission control switching element to be controlled by the nth light-emission signal supplied from the nth light-emission line and connected between the third node and the light emitting element; and a capacitor connected between the first driving power line and first node.

The demultiplexer may simultaneously supply the image data signal to a first set of three pixel columns including the first pixel column, and to simultaneously supply the image data signal to a second set of three pixel columns including the second pixel column after a predetermined time elapses, during the first frame period, and simultaneously supply the image data signal to the second set of three pixel columns, and to simultaneously supply the image data signal to the first set of three pixel columns after a predetermined time elapses, during the second frame period.

In accordance with another embodiment, a method for driving a display device includes supplying an image data signal to a first pixel column, and supplying the image data signal to a second pixel column after a predetermined time elapses, through a demultiplexer during a first frame period; and supplying the image data signal to the second pixel column, and supplying the image data signal to the first pixel column after a predetermined time elapses, through the demultiplexer during a second frame period.

The method may include supplying control signals which determine an order of driving pixel columns including the first and second pixel columns to the demultiplexer, and may include changing the control signals for the first and second frame periods. The first frame period may be a 2p−1th frame period, and the second frame period may be a 2pth frame period.

The first period may include at least two horizontal periods, and supplying the image data signal to the first pixel column, and supplying the image data signal to the second pixel column after a predetermined time elapses, during the first frame period may be performed during a first horizontal period. Supplying the image data signal to the second pixel column, and supplying the image data signal to the first pixel column after a predetermined time elapses, during the second frame period may be performed during a second horizontal period.

The first horizontal period may be a 2q−1th horizontal period, and the second horizontal period may be a 2qth horizontal period. The method may include compensating for an input image data signal, and outputting the image data signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
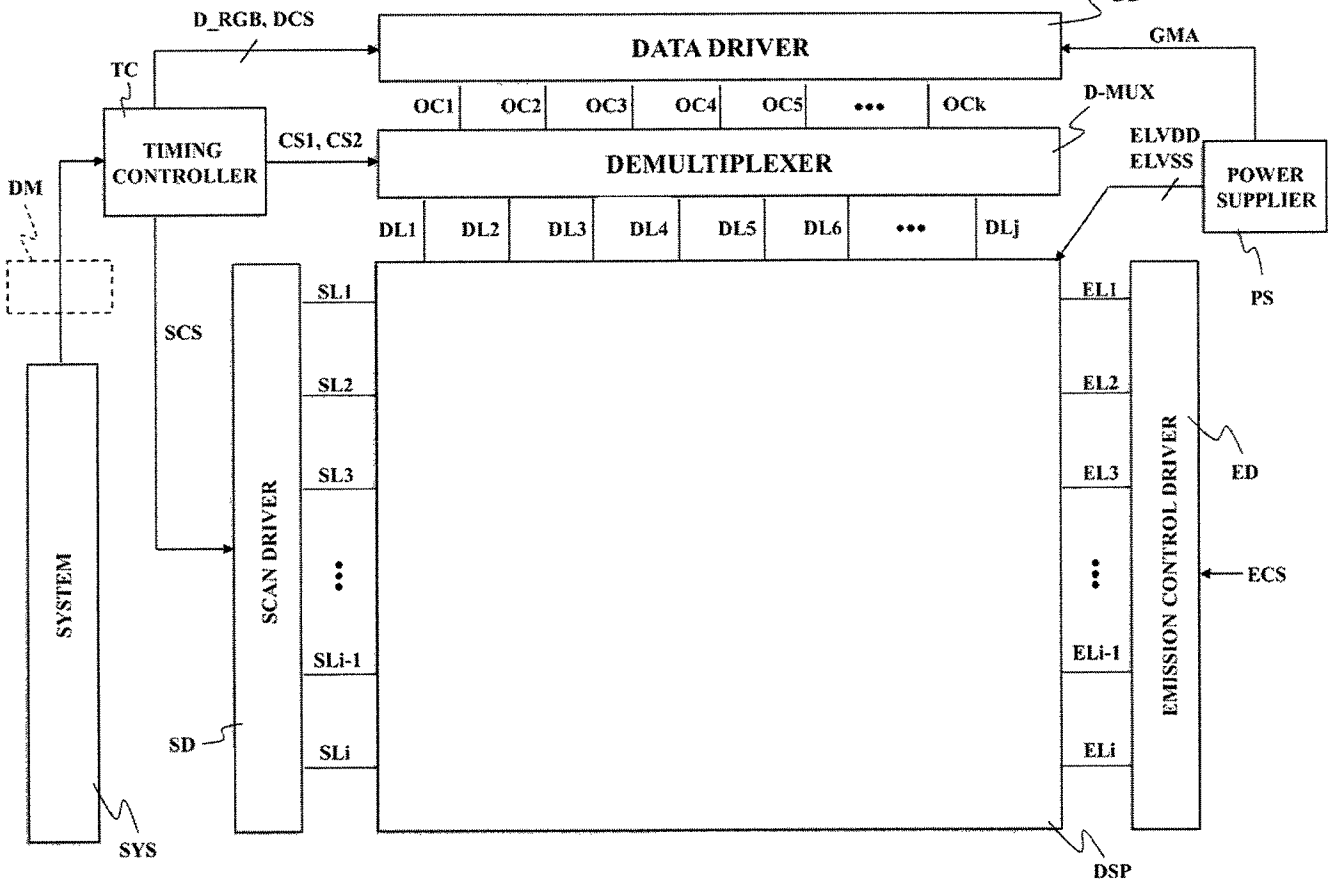
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

Figure 2:
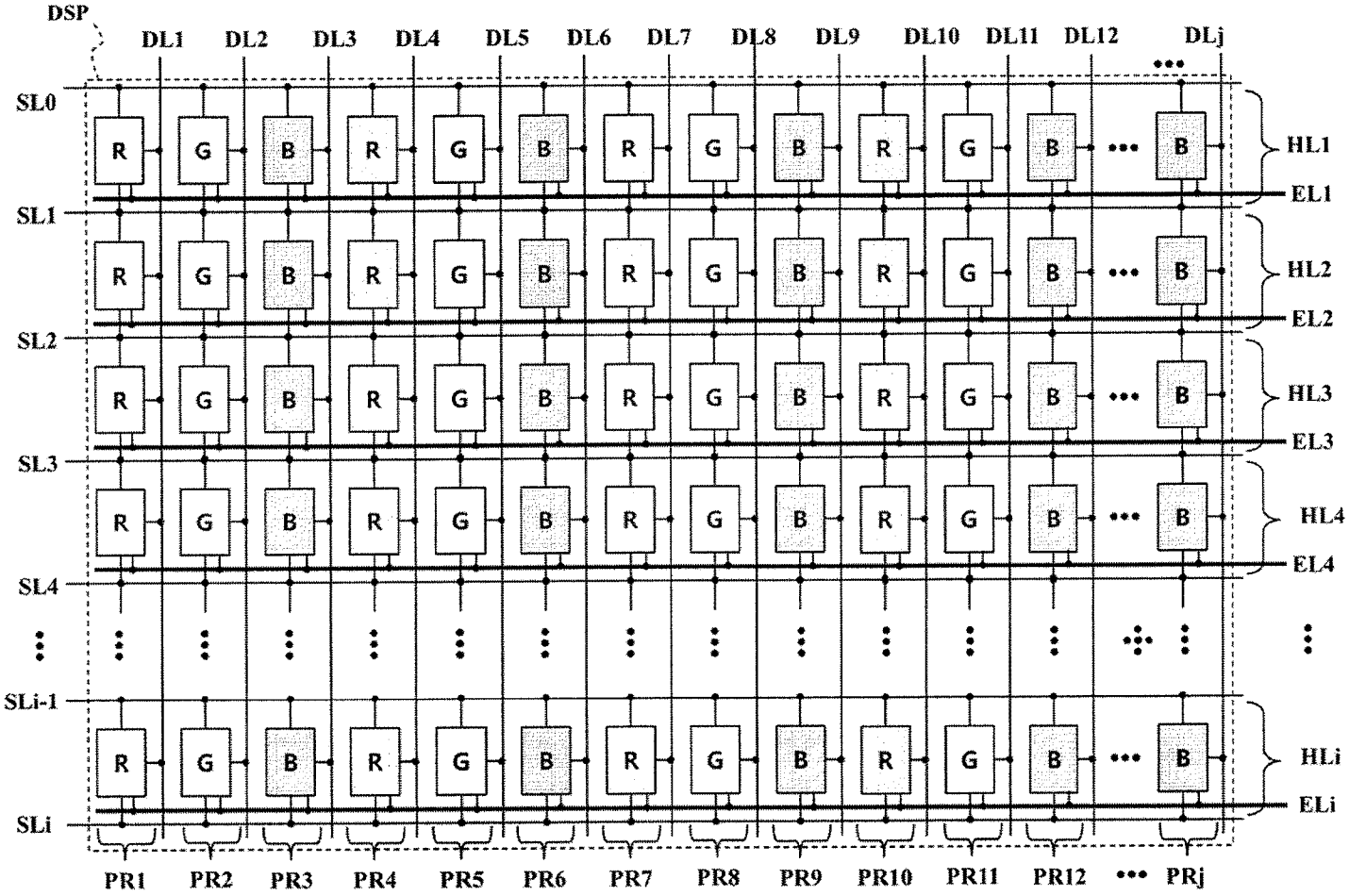
FIG. 2 illustrates an example of a pixel arrangement in the display device of FIG. 1.

FIG. 1 illustrates an embodiment of a display device which includes light-emitting elements, and FIG. 2 illustrates an example of a pixel arrangement in the display device of FIG. 1.

As illustrated in FIG. 1, the light emitting element display device includes a display panel DSP, a system SYS, a timing controller TC, a scan driver SD, a light-emission control driver ED, a data driver DD, a demultiplexer D-MUX, and a power supplier PS. The display panel DSP includes, as illustrated in FIG. 2, i*j pixels R, G, and B (each of i and j is a natural number larger than 1), i+1 scan lines SL0 to SLi, i light-emission control lines EL1 to ELi, and j data lines DL1 to DLj.

First to ith scan signals are respectively supplied to the first to the ith scan lines SL1 to SLi. First to ith light-emission signals are respectively supplied to the first to the ith light-emission control lines EL1 to ELi. First to jth image data signals are respectively supplied to the first to the jth data lines DL1 to DLj. A dummy scan signal is supplied to the dummy scan line SL0, and this dummy scan signal is output prior to the first scan signal.

A plurality of pixels are arranged in a matrix in a display area of the display panel DSP. The pixels include red pixels R to emit light of a red color, a green pixel G to emit light of a green color, and a blue pixel B to emit light of a blue color. The red, green, and blue pixels R, G, and B are arranged along respective horizontal lines HL1 to HLi. Pixels of one color are arranged along respective pixel columns PR1 to PRj. In this case, the red, green, and blue pixels R, G, and B that are adjacent to each other on one horizontal line correspond to a unit pixel for displaying a unit image.

The display panel DSP includes a first driving power line for supplying a first driving voltage ELVDD and a second driving power line for supplying a second driving voltage ELVSS. The first and the second driving power lines are connected to all of the i*j pixels R, G, and B.

J pixels arranged along an nth (n is one selected from 1 to i) horizontal line (hereinafter, nth horizontal line pixels) are respectively connected to the first to the jth data lines (DL1 to DLj). The nth horizontal line pixels are connected to an n−1th scan line, an nth scan line, and an nth light-emission line, together. Accordingly, the nth horizontal line pixels receive an n−1th scan signal, an nth scan signal, and an nth light-emission signal together. For example, j pixels aligned in the same horizontal line receive the same scan signal and the same light-emission signal. Pixels aligned in different horizontal lines receive different scan signals and different light-emission signals.

However, pixels in an adjacent horizontal line receive one scan signal commonly. For example, both of the red pixel R and the green pixel G on the second horizontal line HL2 receive a first scan signal, a second scan signal, and a second light-emission signal. The red pixel R and the green pixel G on the third horizontal line HL3 receive the second scan signal, a third scan signal, and a third light-emission signal.

The i+1 scan signals are pulse signals that may have substantially the same pulse form but are output at different time points. For example, the dummy scan signal and the first scan signal have the same pulse form, but the dummy scan signal is output prior to the first scan signal. Likewise, i light-emission signals may have substantially the same pulse form, but are output at different time points.

The system SYS outputs vertical synchronizing signals, horizontal synchronizing signals, main clock signals, and image data signals through a low voltage differential signaling (LVDS) receiver and an interface circuit provided in a graphic controller. The vertical and horizontal synchronizing signals and the main clock signal output from the system SYS are supplied to the timing controller TC. The image data signals sequentially output from the system SYS are supplied to timing controller TC.

The timing controller TC generates a scan control signal, a light-emission control signal, and a data control signal based on the vertical and horizontal synchronizing signals and the main clock signal supplied from the system SYS, and supplies the signals to the scan driver SD and the data driver DD, respectively. In addition, the timing controller TC assigns image data signals with respect to respective frame periods according to the vertical synchronizing signal and assigns image data signals with respect to the respective horizontal periods according to the horizontal synchronizing signal. Then, the timing controller TC supplies the divided image data signals to the data driver DD.

Figure 3:
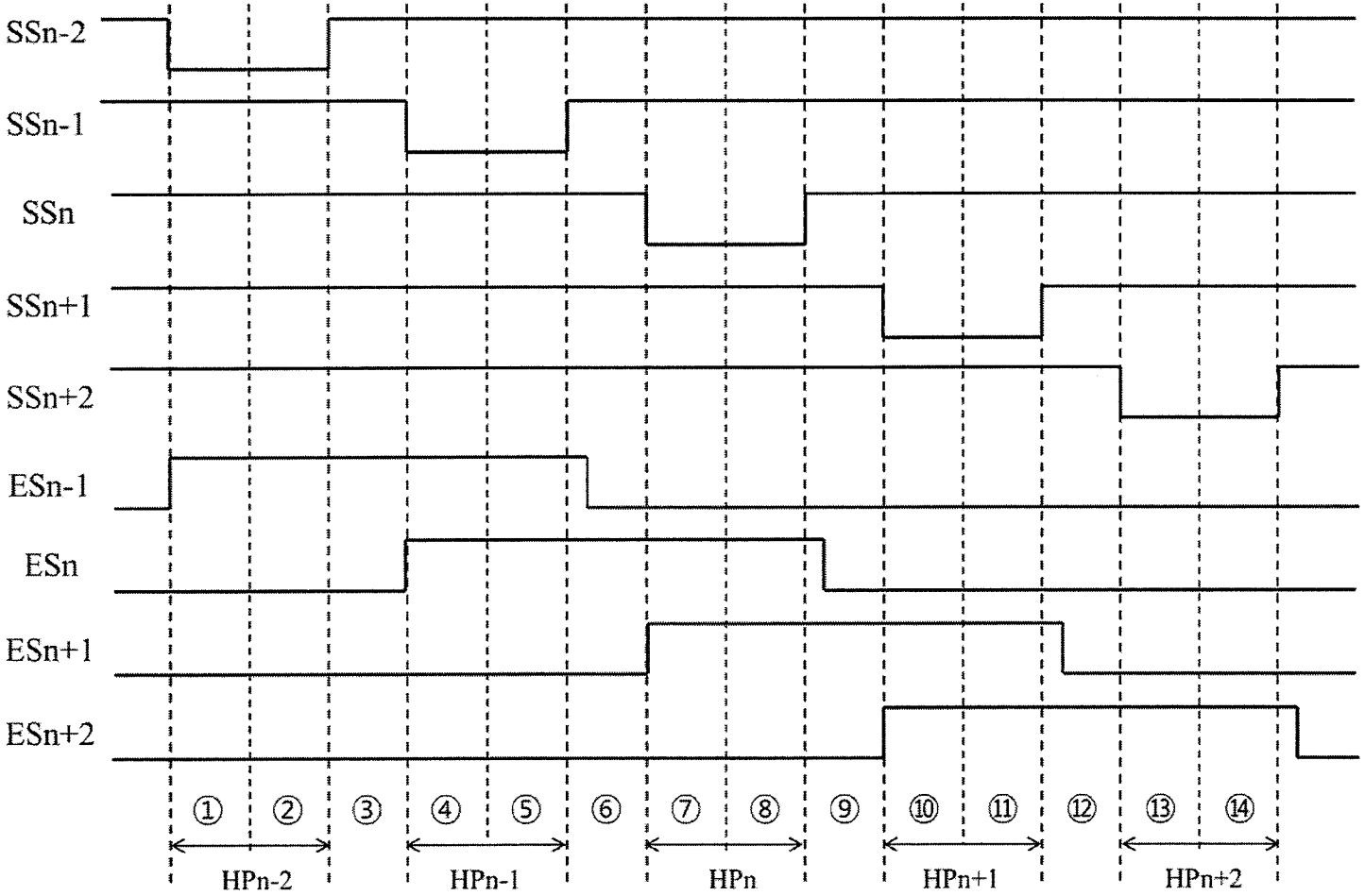
FIG. 3 illustrates examples of scan signals and light-emission signals.

FIG. 3 is a timing diagram illustrating an embodiment of scan signals and light-emission signals. The scan driver SD sequentially produces the first to the ith scan signals according to the scan control signal SCS supplied from the timing controller TC and outputs the scan signals. FIG. 3 illustrates that an n−2th scan signal SSn−2, an n−1th scan signal SSn−1, an nth scan signal SSn, an n+1th scan signal SSn+1 and an n+2th scan signal n+2 are sequentially output.

A horizontal period refers to a period where the respective scan signals maintain an active state (e.g., a low-level state), and this horizontal period may include a first half and a second half. For example, in FIG. 3, a first half ① and a second half ② are first and second halves of the n−2th horizontal period HPn−2, respectively. Further, there is a blank period between adjacent horizontal periods. For example, there is a sixth period ⑥ between the n−1th horizontal period HPn−1 and the nth horizontal period HPn. This sixth period ⑥ is or includes a gap period between the n−1th horizontal period HPn−1 and the nth horizontal period HPn. A length of the active periods of the scan signals may be suitably adjusted in consideration of the gap period.

One scan line is selected every horizontal period by the scan signal and the pixels connected to the scan line are operated. For example, when the nth scan line is selected by the nth scan signal SSn, the nth horizontal line pixels and the n+1th horizontal line pixels connected to the nth scan line are operated. The first to the ith scan signals including the dummy scan signal may have a voltage of −10 [V] in an active state and 14 [V] in an inactive state.

The light-emission control driver ED sequentially produces the first to the ith light-emission signals according to the light-emission control signals ECS the timing controller TC and outputs the light-emission signals. The first to ith light-emission signals determine light-emission periods of the corresponding horizontal line pixels. For example, a light-emission period of nth horizontal line pixels is determined by an nth light-emission signal. For example, as illustrated in FIG. 3, a length of a period, during which the nth light-emission signal ESn keeps the active state (e.g., a low-level state), corresponds to the light-emission period. The first to the ith light-emission signals may have a voltage of −10 [V] in an active state and 14 [V] in a non-active state.

The data driver DD supplies the j image data signals D_RGB to the j data lines DL1 to DLj via the demultiplexer D-MUX every horizontal period. For example, the data driver DD performs a sampling of the image data signals D_RGB from the timing controller TC according to the data control signal DCS from the timing controller TC, performs a latching operation of the sampled image data signals corresponding to one horizontal line every horizontal period, converts the latched image data signals into analog signals using a gamma voltage GMA supplied from the power supplier PS, and supplies the j image data signals that are converted to the analog signals to the demultiplexer D-MUX.

In this case, the data driver DD divides the j image data signals into two halves and sequentially outputs the two divided image data signals during one horizontal period. For example, part of the j image data signals are simultaneously output through k output channels OC1 to OCk during the first half of the horizontal period (first half ½H). Then, the other image data signals are simultaneously output through the k output channels OC1 to OCk during the second half of the horizontal period (second half ½H).

The power supplier PS produces the gamma voltage GMA, the first driving voltage ELVDD, and the second driving voltage ELVSS. The first driving voltage ELVDD may be a DC voltage of 12[V] and the second driving voltage ELVSS may be a DC voltage of 2[V]. ELVDD or ELVSS may be different in other embodiments.

Figure 4:
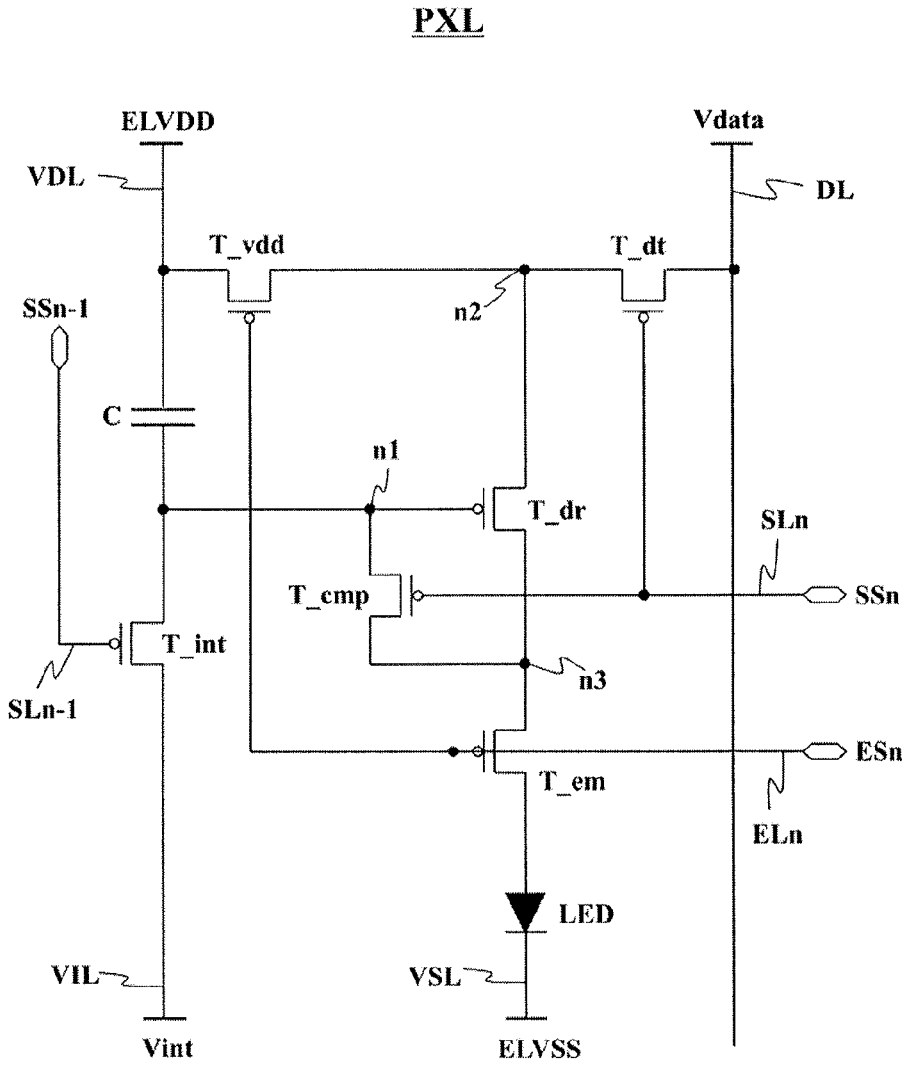
FIG. 4 illustrates an embodiment of a pixel.

FIG. 4 illustrates an embodiment of a pixel PXL, which, for example, may be included in an nth horizontal line of the display device described above. As illustrated in FIG. 4, the pixel PXL includes a driving switching element T_dr, an initiating switching element T_int, a compensating switching element T_cmp, a data switching element T_dt, a static power switching element T_vdd, a light-emission control switching element T_em, a capacitor C, and a light emitting element.

The driving switching element T_dr is controlled by a signal of the first node n1 and is connected between a second node n2 and a third node n3.

The initiating switching element T_int is controlled by the n−1th scan signal SSn−1 from the n−1th scan line SLn−1 and is connected between the first node n1 and an initiating power line VIL. The initiating power line VIL transmits an initiating voltage Vint, which, for example, may be supplied from the power supplier to the initiating power line VIL.

The compensating switching element T_cmp is controlled by the nth scan signal SSn supplied from the nth scan line SLn and is connected between the first node n1 and the third node n3.

The data switching element T_dt is controlled by the nth scan signal SSn supplied from the nth scan line SLn and is connected between the data line DL and the second node n2.

The static power switching element T_vdd is controlled by the nth light-emission signal ESn supplied from the nth light-emission control line ELn and is connected between the second node n2 and the first driving power line VDL.

The light-emission control switching element T_em is controlled by the nth light-emission signal ESn supplied from the nth light-emission control line ELn and is connected between the third node n3 and the light emitting element.

The capacitor C is connected between the first driving power lien VDL and the first node n1.

The light emitting element is connected between the light-emission control switching element T_em and the second driving power line VSL. An organic light emitting diode may be used as the light emitting element. In this case, an anode electrode of the light emitting element is connected to the light-emission control switching element T_em and a cathode electrode of the light emitting element is connected to the second driving power line VSL.

The nth horizontal line pixels PXL operate corresponding to sequentially triggering initiation period, threshold voltage detection period, and light-emission period. Accordingly, the scan signals and the light-emission signals may change state into an active state or a non-active state based on the sequentially triggering periods of the initiation period, the threshold voltage measurement period, and the light-emission period.

An active state of a signal may refer to a state where the switching element that receives the signal is turned on. An inactive state of a signal may refer to a state where the switching element that receives the signal is turned off. According to one embodiment, N-type or P-type transistors may be used as the driving switching element T_dr, the initiation switching element T_int, the compensation switching element T_cmp, the data switching element T_dt, the static power switching element T_vdd, and the light-emission control switching element T_em.

When the switching elements are all N-type transistors, the active state corresponds to when a high control voltage is applied and the inactive state corresponds to when a low control voltage is applied. In contrast, when the switching elements are all P-type transistors, the active state corresponds to when a low control voltage is applied and the inactive state corresponds to when a high control voltage is applied. In at least one of the embodiments described below, it is assumed that all the switching elements are P-type transistors.

Firstly, performance of the pixel during the n−1th horizontal period HPn−1, namely, the initiation period, will be described. During the initiation period HPn−1, the n−1th scan signal SSn−1 is in the active state, while the nth scan signal SSn and the nth light-emission signal ESn are in the inactive state. Therefore, the initiation switching element T_int, that receives the n−1th scan signal SSn−1 in the active state through the gate electrode, is turned on. The other switching elements are all turned off.

Then, an initiating voltage Vint is applied to the first node n1, that is, a gate electrode of the driving switching element T_dr, via the turned-on initiating switching element T_int. Accordingly, a voltage stored in the capacitor C, that is, a voltage of the gate electrode of the driving switching element T_dr, is initiated.

Next, performance of the pixel during the nth horizontal period HPn, namely, the threshold voltage detection period HPn, will be described. During the threshold voltage measurement period HPn, the nth scan signal SSn is in the active state, while the n−1th scan signal SSn−1 and the nth light-emission signal ESn are in the inactive state. Therefore, the compensating switching element T_cmp and the data switching element T_dt, that receive the nth scan signal SSn in the active state through the gate electrode, are turned on. The other switching elements are all turned off. Then, the driving switching element T_dr is connected to the circuit as a diode by the turned-on compensating switching element T_cmp.

Subsequently, an image data signal Vdata is applied to the second node n2 via the turned-on data switching element T_dt. Thus, a gate-source voltage of the driving switching element T_dr exceeds a threshold voltage thereof. The driving switching element T_dr is therefore turned on. Accordingly, electric charges are stored in the first node n1 through the turned-on driving switching element T_dr. As a result, the driving switching element T_dr is turned off when voltage across the first node n1 and the second node n2 becomes equivalent to the threshold voltage of the driving switching element T_dr. In this case, a voltage obtained by subtracting the threshold voltage of the driving switching element T_dr from the image data signal is stored in the capacitor C.

Next, performance of the pixel after an eighth period ⑧, namely, the light-emission period, will be described. During the light-emission period (for example, a ninth period ⑨), the nth light-emission period ESn is in the active state, while the n−1th scan signal SSn−1 and the nth scan signal SSn are in the inactive state. Therefore, the light-emission control switching element T_em and the static power switching element T_vdd, that receive the nth light-emission signal ESn in the active state through the gate electrode, are turned on. The other switching elements are all turned off.

Then, the driving switching element T_dr is electrically connected to the light emitting element by the turned-on light-emission control switching element T_em.

Further, a first driving voltage ELVDD is applied to the second node n2, that is, a source electrode of the driving switching element T_dr, through the turned-on static power switching element T_vdd. Accordingly, the driving switching element T_dr is turned on and the turned-on driving switching element T_dr supplies a driving current corresponding to the voltage stored in the capacitor to the light emitting element. Subsequently, the light emitting element emits light by the driving current.

Figure 5:
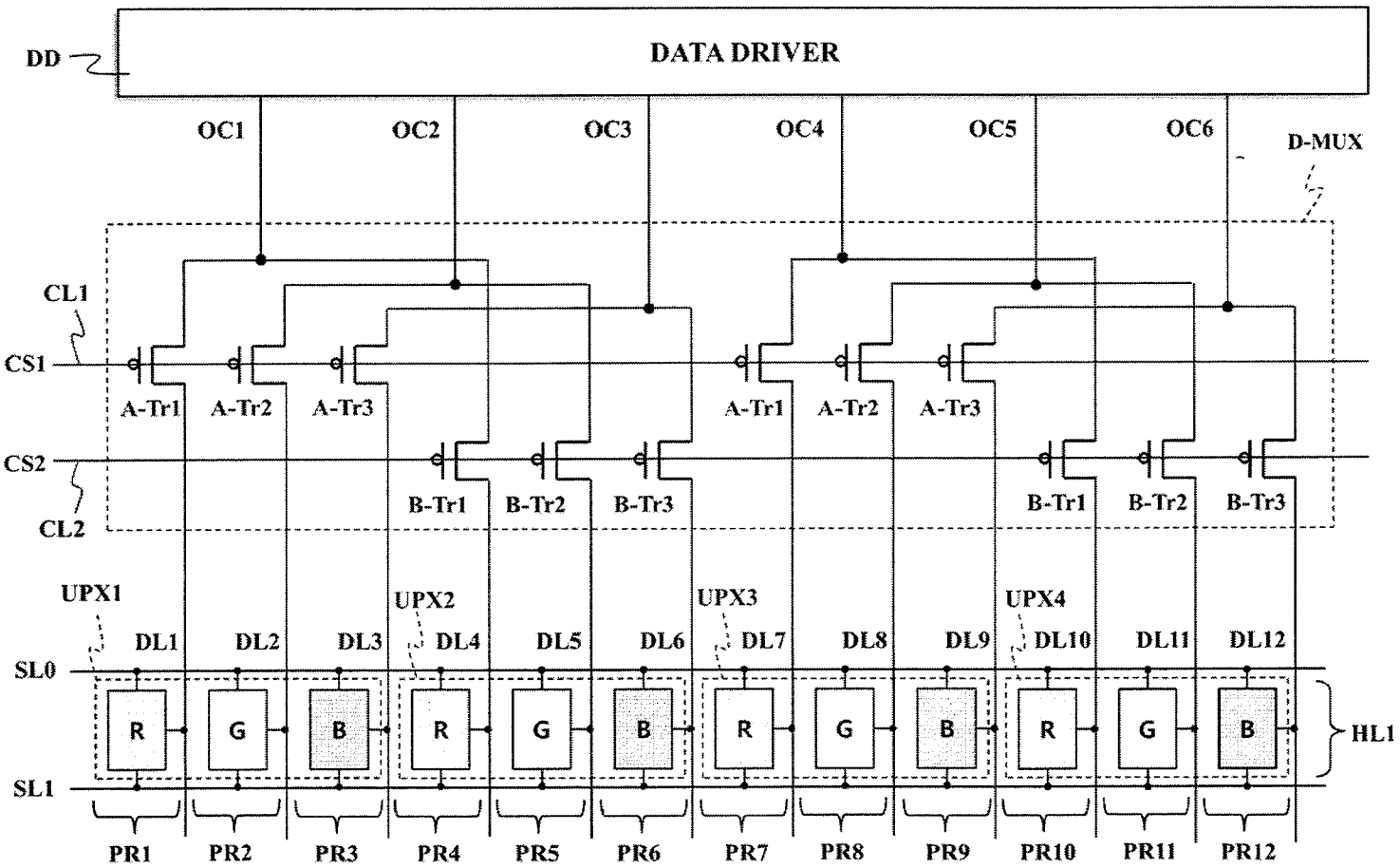
FIG. 5 illustrates an embodiment of a demultiplexer of FIG. 1.

FIG. 5 illustrates an embodiment of a demultiplexer D-MUX, which, for example, may be the demultiplexer in FIG. 1. The demultiplexer D-MUX timely divides the j image data signals from the data driver DD and outputs the divided data signals to the data lines DL1 to DLj.

To perform this operation, the demultiplexer D-MUX includes a plurality of A-switching elements A-Tr1, A-Tr2, and A-Tr3 that maintain a turned-on state during one of the first half or the second half of one horizontal period, and a plurality of B-switching elements B-Tr1, B-Tr2, and B-Tr3 that maintain the turned-on state in the other of the first half or the second half of one horizontal period.

The demultiplexer D-MUX receives the first control signal CS1 and the second control signal CS2. For example, the first control signal CS1 is supplied to gate electrodes of the A-switching elements A-Tr1, A-Tr2, and A-Tr3 over a first control line CL1, and the second control signal CS2 is supplied to gate electrodes of the B-switching elements B-Tr1, B-Tr2, and B-Tr3 over a second control line CL2.

During the first half, the first control signal CS1 may have the active state (e.g., a low-level state) and the second control signal CS2 may have the inactive state (e.g., a high-level state). During the second half, the first control signal CS1 may have the inactive state and the second control signal CS2 may have the active state. When the first control signal CS1 has the active state during the first half of one horizontal period and the second control signal CS2 has the active state during the second half of one horizontal period in a structure such as in FIG. 5, odd-numbered unit pixels UPX1 and UPX3 are supplied with corresponding image data signals during the first half and even-numbered unit pixels UPX2 and UPX4 are supplied with corresponding image data signals during the second half.

The demultiplexer D-MUX timely divides the image data signals of the same color. For example, the demultiplexer D-MUX timely divides the image data signals and supplies the divided image data signals to the data lines connected to the pixels of the same color. For this purpose, as illustrated in FIG. 5, the first A-switching element A-Tr1 and the first B-switching element B-Tr1 (that are connected to the first output channel OC1 together) are respectively connected to the first and the fourth data lines DL1 and DL4. Further, pixels of the same color, for example, red pixels R, are connected to the first and the fourth data lines DL1 and DL4.

The second A-switching element A-Tr2 and the second B-switching element B-Tr2 (that are connected to the second output channel OC2 together) are respectively connected to the second and the fifth data lines DL2 and DL5. Further, pixels of the same color, for example, green pixels G, are connected to the second and the fifth data lines DL2 and DL5.

The third A-switching element A-Tr3 and the third B-switching element B-Tr3 (that are connected to the third output channel OC3 together) are respectively connected to the third and the sixth data lines DL3 and DL6. Further, pixels of the same color, for example, blue pixels B, are connected to the third and the sixth data lines DL3 and DL6.

In this case, the data driver DD outputs red image data signals through the first output channel OC1, green image data signals through the second output channel OC2, and blue image data signals through the third output channel OC3.

The demultiplexer D-MUX supplies the image data signal to at least one of the pixel columns PR1 to PRj and supplies the image data signal to at least one of the other pixel columns PR1 to PRj after a predetermined time elapses during one frame period. Further, the demultiplexer D-MUX supplies the image data signal to the at least one of the other pixel columns PR1 to PRj and supplies the image data signal to at least one of the other pixel columns PR1 to PRj after a predetermined time elapses during another frame period. Herein, one frame period may be a 2p−1th frame period (p is a natural number) and another frame period may be a 2pth frame period.

For example, as illustrated in FIG. 5, the demultiplexer D-MUX supplies the image data signal to the first pixel column PR1 and supplies the image data signal to the fourth pixel column PR4 after a predetermined time elapses during the first frame period. Further, the demultiplexer D-MUX supplies the image data signal to the fourth pixel column PR4 and supplies the image data signal to the first pixel column PR1 after a predetermined time elapses during the second frame period. In other words, the demultiplexer D-MUX firstly supplies the image data signal to the first pixel column PR1 among the first and the fourth pixel columns PR1 and PR4 during the first frame period, while firstly supplying image data signals to the fourth pixel column PR4 among the first and the fourth pixel columns PR1 and PR4 during the first frame period.

Further, the demultiplexer D-MUX simultaneously supplies the image data signal to three pixel columns of the pixel columns and simultaneously supplies the image data signal to another three pixel columns after a predetermined time elapses during one frame period. Further, the demultiplexer D-MUX simultaneously supplies the image data signal to the another three pixel columns and simultaneously supplies the image data signal to the three pixel columns after a predetermined time elapses during another frame period.

For example, as illustrated in FIG. 5, the demultiplexer D-MUX simultaneously supplies the image data signal to the first to the third pixel columns PR1 to PR3 of the first unit pixel UPX1 and simultaneously supplies the image data signal to the fourth to the sixth pixel columns PR4 to PR6 of the second unit pixel UPX2 after a predetermined time elapses during the first frame period. Further, the demultiplexer D-MUX simultaneously supplies the image data signal to the fourth to the sixth pixel columns PR4 to PR6 of the second unit pixel UPX2 and simultaneously supplies the image data signal to the first to the third pixel columns PR1 to PR3 of the first unit pixels UPX1 after a predetermined time elapses during the second frame period.

In order to operate the demultiplexer D-MUX, the display device according to one embodiment may include a controller that supplies the control signals CS1 and CS2. The controller may change the control signals CS1 and CS2 corresponding to respective frame periods. The controller may be inside the timing controller TC or the timing controller TC itself may function as the controller. For example, the timing controller TC may generate the control signals CS1 and CS2, and may also change the control signals CS1 and CS2 and output the signals corresponding to the respective frame periods.

In order to operate the demultiplexer D-MUX, an input order of the control signals supplied to the demultiplexer D-MUX may be changed for respective periods. For example, an input order of the control signals CS1 and CS2 supplied to the demultiplexer D-MUX may be different between at least two frame periods. This will be described in more detail with reference to FIGS. 6A and 6B.

Figure 6A:
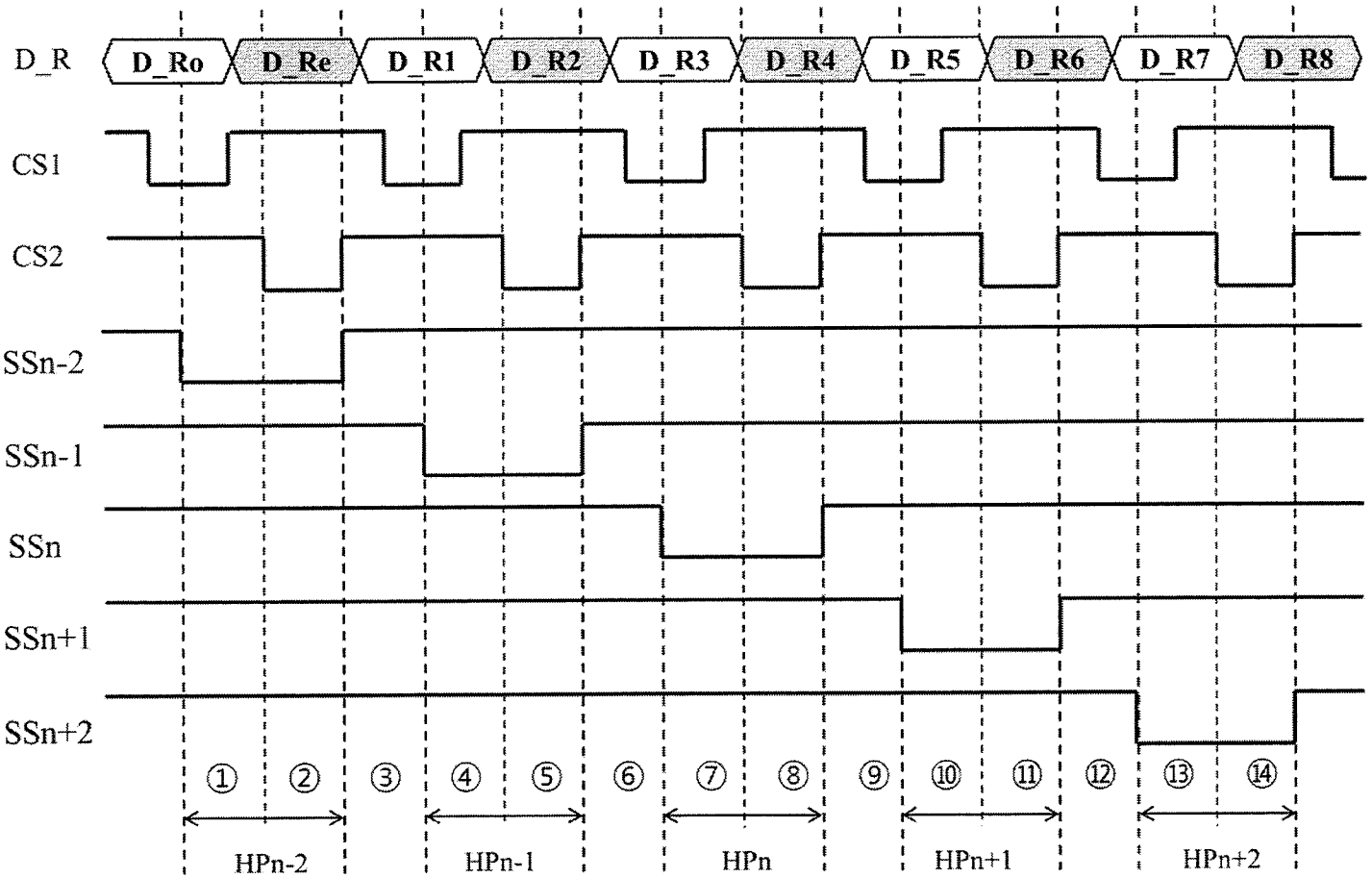
FIG. 6A illustrates a red image data signal, a control signal, and a scan signal applied during a first frame period of a first embodiment.
Figure 6B:
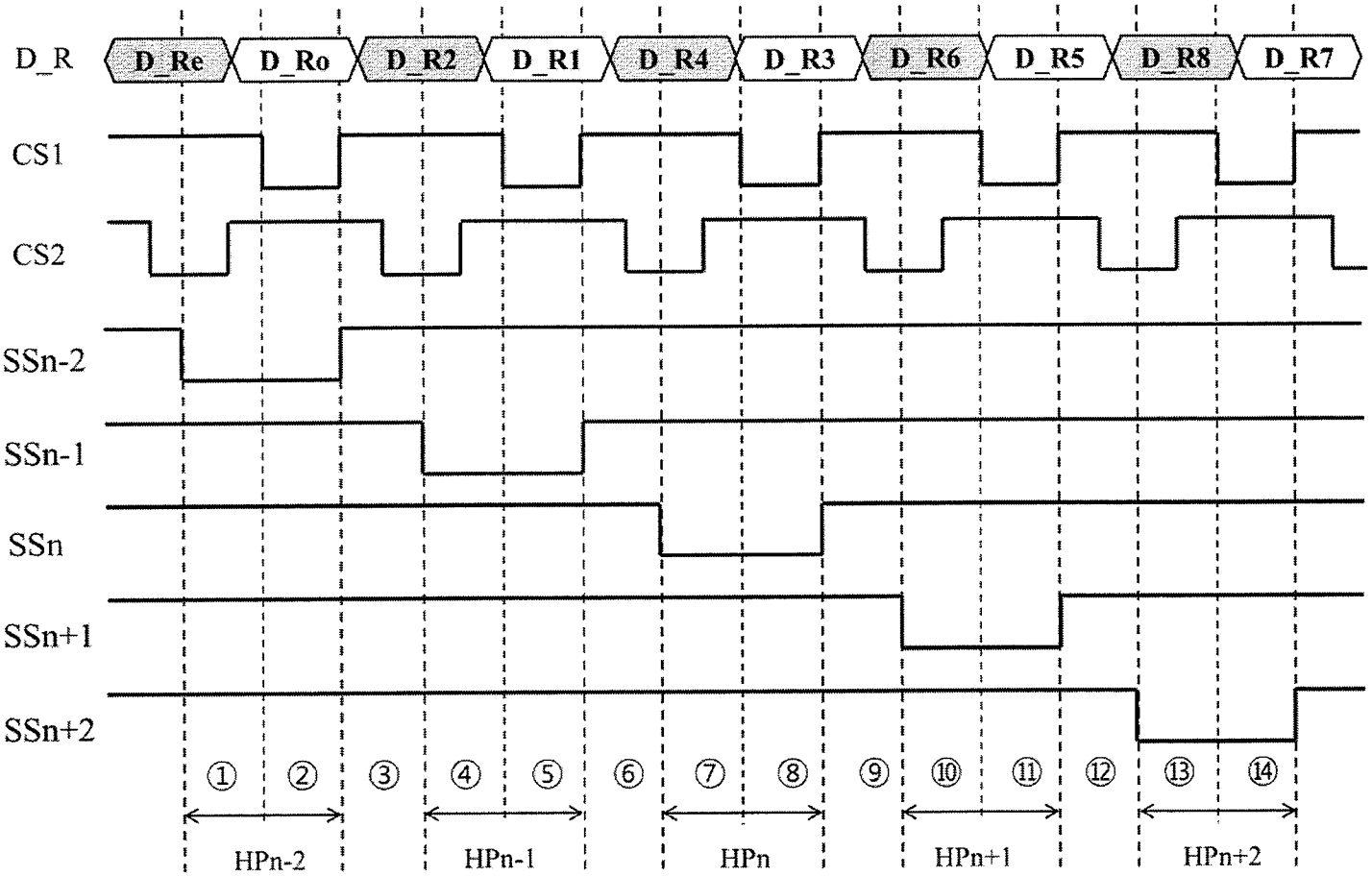
FIG. 6B illustrates a red image data signal, a control signal, and a scan signal applied during a second frame period of the first embodiment.

FIG. 6A is a timing diagram illustrating examples of red image data signals, control signals, and scan signals applied during the first frame according to a first embodiment. FIG. 6*b* is a timing diagram illustrating examples of red image data signals, control signals, and scan signals applied during the second frame according to the first embodiment.

As illustrated in FIGS. 6A and 6B, an input order of the control signals CS1 and CS2 supplied to the demultiplexer D-MUX during the first frame period is different from an input order of the control signals CS1 and CS2 supplied to the demultiplexer D-MUX during the second frame period. For example, the input order of the control signals CS1 and CS2 in the second frame period may be in reverse order of the input order of the control signals CS1 and CS2 in the first frame period.

In one embodiment, the first control signal CS1 is output prior to the second control signal CS2 during the first frame period, and the second control signal CS2 is output prior to the first control signal CS1 during the second frame period. In other words, as illustrated in FIGS. 6*a* and 6*b*, the respective first and second frame periods include a plurality of horizontal periods and the input orders of the control signals CS1 and CS2 in corresponding horizontal periods in different frame periods are different from each other.

For example, in the nth horizontal period HPn of the first frame period illustrated in FIG. 6A, the first control signal CS1 is output during the first half ⑦ of the period HPn and the second control signal CS2 is output during the second half ⑧ of the period HPn. In contrast, in the nth horizontal period HPn of the second frame period illustrated in FIG. 6B, the second control signal CS2 is output during the first half ⑦ of the period HPn and the first control signal CS1 is output during the second half ⑧ of the period HPn.

In addition, the input order of the image data signals supplied to the demultiplexer D-MUX may be changed in accordance with the input order of the control signals CS1 and CS2. For example, the input order of the image data signals supplied to the demultiplexer D-MUX during the first frame period is in reverse order of the input order of the image data signals supplied to the demultiplexer D-MUX during the second frame period.

In one embodiment, in the nth horizontal period HPn of the first frame period illustrated in FIG. 6A, a third red image data signal D_R3 is output during the first half ⑦ of the period HPn and a fourth red image data signal D_R4 is output during the second half ⑧ of the period HPn. In contrast, in the nth horizontal period HPn of the second frame period illustrated in FIG. 6B, the fourth red image data signal D_R4 is output during the first half ⑦ of the period HPn and the third red image data signal D_R3 is output during the second half ⑧ of the period HPn.

According to the first embodiment, the control signals CS1 and CS2 may be selectively output in the order illustrated in FIGS. 6A and 6B only in a predetermined number of frame periods. Further, according to one embodiment, the first and the second control signals CS1 and CS2 may be supplied to the demultiplexer D-MUX in the order illustrated in FIG. 6B every odd-numbered frame period. Further, the first and the second control signals CS1 and CS2 may be supplied to the demultiplexer D-MUX in the order illustrated in FIG. 6B every even-numbered frame period.

In FIGS. 6A and 6B, D_R refers to a red image data signal. Also, D_Ro and D_Re correspond to red image data signals corresponding to the respective pixels in the red image data signals and respectively refer to an odd-numbered red image data signal and an even-number red image data signal.

The order of the control signals is changed corresponding to the respective frame periods in FIGS. 6A and 6B, to reduce image quality deterioration caused by a circuit structure of the pixel and a coupling structure between pixels, which will be described below with reference to FIG. 7.

Figure 7:
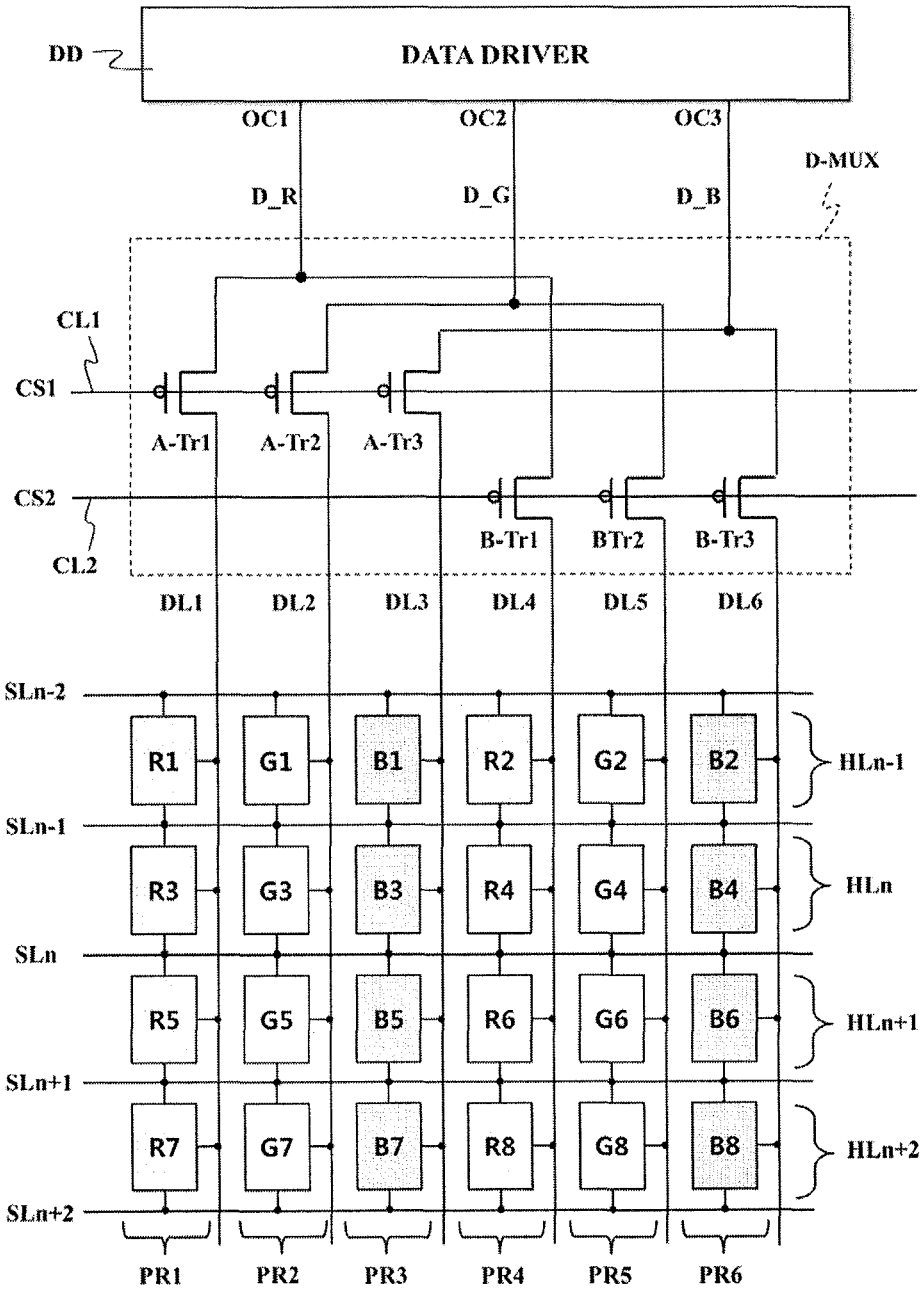
FIG. 7 illustrates pixels connected to a demultiplexer according to an embodiment.

FIG. 7 illustrates a plurality of pixels connected to a demultiplexer according to one embodiment. As illustrated in FIG. 7, the nth horizontal line pixels R3, G3, B3, R4, G4, and B4 are connected to the n−1th scan line SLn−1 and the nth scan line SLn together. The third and the fourth red pixels R3 and R4 sequentially receive red image data signals D_R. The third and the fourth green pixels G3 and G4 sequentially receive green image data signals D_G. The third and the fourth blue pixels B3 and B4 sequentially receive blue image data signals D_B.

Performance of the third and the fourth red pixels R3 and R4 that sequentially receive the timely-divided red image data signals of the nth horizontal line pixels HLn will now be described.

Firstly, performance of the third and the fourth red pixels R3 and R4 in the n−1th horizontal period HPn−1 of the first frame period will be described. In the n−1th horizontal period HPn−1 in the first frame period, the third and the fourth red pixels R3 and R4 are initiated. For example, the n−1th scan signal SSn−1 in an active state generated during the n−1th horizontal period HPn−1 is input to the n−1th scan line SLn−1, such that the n−1th scan line SLn−1 is selected. Thus, the third and the fourth red pixels R3 and R4 connected to the selected n−1th scan line SLn−1 may operate.

In this case, as illustrated in FIG. 4, the n−1th scan signal SSn−1 input to the third and fourth red pixels R3 and R4 turns on the initiating switching element T_int of the pixels R3 and R4, such that a voltage of the first node n1 of the pixels R3 and R4 is initiated. At the same time, the n−1th scan signal SSn−1 is supplied to the pixels R1, G1, B1, R2, G2, and B2 of the n−1th horizontal line HLn−1, such that the pixels R1, G1, B1, R2, G2, and B2 may operate. Accordingly, the pixels in the n−1th horizontal line HLn−1 receive the image data signals input over the corresponding data lines.

For example, the first red pixel R1 receives the first red image data signal D_R1 applied to the first data line DL1, while the second red pixel R2 receives the second red image data signal D_R2 applied to the fourth data line DL4. Accordingly, the third and fourth red pixels R3 and R4 are initiated during the n−1th horizontal period HPn−1, the first red image data signal D_R1 is stored in the first data line DL1 connected to the third red pixel R3, and the second red image data signal D_R2 is stored in the fourth data line DL4 connected to the fourth red pixel R4.

Performance of the third and the fourth red pixels R3 and R4 during the first half ⑦ of the nth horizontal period HPn in the first frame period will now be described.

During the first half ⑦ of the nth horizontal period HPn, the first control signal CS1 becomes in an active state, the first A-switching element A-Tr1 is turned on, and the third red image data signal D_R3 is applied to the first data line DL1 through the turned-on first A-switching element A-Tr1. Meanwhile, the second control signal CS2 is in an inactive state in the first half ⑦. Thus, the first B-switching element B_Tr1 is in a turned-off state and the fourth data line DL4 connected thereto maintains a floating state. The second red image data D_R2 that has been applied during the n−1th horizontal period HPn−1 is stored in the fourth data line DL4 in the floating state.

During the first half ⑦, the nth scan signal SSn is in an active state. Thus, the third and the fourth red pixels R3 and R4 that receive the nth scan signal SSn over the nth scan line SLn may simultaneously operate. In this case, as illustrated in FIG. 4, the nth scan signal SSn applied to the third and the fourth red pixels R3 and R4 turns on the data switching element T_dt and the compensating switching element T_cmp of the pixels R3 and R4, such that the corresponding image data is applied to each first node n1 of the pixels R3 and R4. For example, the third red pixel R3 receives a third red image data signal D_R3 that is correct image data, and the fourth red pixel R4 receives a second red image data signal D_R2 that is image data for another pixel.

Performance of the third and the fourth red pixels R3 and R4 during the second half ⑧ of the nth horizontal period HPn in the first frame period will now be described.

During the second half ⑧ of the nth horizontal period HPn, the second control signal CS2 is in the active state, the first B-switching element B-Tr1 is turned on, and the fourth red image data signal D_R4 is applied to the fourth data line DL4 through the turned-on first B-switching element B-Tr1. Meanwhile, the first control signal CS1 is in the inactive state during the second half ⑧. Thus the first A-switching element A_Tr1 is in a turned-off state and the first data line DL1 connected to the first A-switching element A_Tr1 maintains a floating state. As a result, the third red image data signal D_R3 (applied during the first half ⑦) is stored in the first data line DL1 in the floating state.

During the second half ⑧, the nth scan signal SSn is in the active state. Thus, the third and the fourth red pixels R3 and R4 that receive the nth scan signal SSn over the nth scan line SLn may simultaneously operate. In this case, as illustrated in FIG. 4, the nth scan signal SSn applied to the third and the fourth red pixels R3 and R4 turns on the data switching element T_dt and the compensating switching element T_cmp of the pixels, such that the corresponding image data signals are applied to each first node n1 of the pixels R3 and R4.

For example, the third red pixel R3 receives the third red image data signal D_R3 that is correct image data. However, the fourth red pixel R4 may or may not receive the fourth red image data signal D_R4, that is, the correct image data signal. In other words, unlike the third red pixel R3 that receives the correct image data right after initiation, the fourth red pixel R4 receives an image data signal for another pixel right after initiation, such that the correct image data signal may not be applied to the fourth red pixel R4 depending on the size of the image data signal of the another pixel.

For example, the fourth red image data signal D_R4 may be properly input to the fourth red pixel R4 when a correct fourth red image data signal D_R4 is larger than the incorrect second red image data signal D_R2. In contrast, the fourth red image data signal D_R4 may not be applied to the fourth red pixel R4 when the fourth red image data signal D_R4 is the same as or smaller than the second red image data signal D_R2. This maybe due to a circuit structure of the pixel in FIG. 4. That is, because the driving switching element T_dr is connected to the circuit as a diode during the nth horizontal period HPn including the second half ⑧, the fourth red image data signal D_R4 may not be applied to the first node n1 when the first node n1 is already stored with a voltage larger than the fourth red image data signal D_R4.

Therefore, during the first frame period, the first, third, fifth, and seventh red pixels R1, R3, R5, and R7, which receive the correct image data signals right after initiation due to the first control signal CS1 that is output relatively early, may display an image having normal luminance. In contrast, the second, fourth, sixth, eighth red pixels R2, R4, R6, and R8, which receive image data signals of other pixels prior to the correct image data signals after initiation, may display an image having abnormal luminance.

Likewise, during the first frame period, the first, third, fifth, and seventh green pixels G1, G3, G5, and G7 may display an image having normal luminance, whereas the second, fourth, sixth, and eighth green pixels G2, G4, G6, and G8 may display an image having abnormal luminance.

Likewise, during the first frame period, the first, third, fifth, and seventh blue pixels B1, B3, B5, and B7 may display an image having normal luminance, whereas the second, fourth, sixth, and eighth blue pixels B2, B4, B6, and B8 may display an image having abnormal luminance.

However, during the second frame period, the input order of the first and the second control signals CS1 and CS2 is reversed. Thus, the second, fourth, sixth, and eighth red pixels R2, R4, R6, and R8, which receive the correct image data signals right after the initiation due to the second control signal CS2 that is output relatively early, may display an image having normal luminance. The first, third, fifth, and seventh red pixels R1, R3, R5, and R7, which receive image data signals of other pixels prior to the correct image data signals after initiation, may display an image having abnormal luminance.

Likewise, during the second frame period, the second, fourth, sixth, and eighth green pixels G2, G4, G6, and G8 may display an image having normal luminance, whereas while the first, third, fifth, and seventh green pixels G1, G3, G5, and G7 may display an image having abnormal luminance.

Likewise, during the second frame period, the second, fourth, sixth, and eighth blue pixels B2, B4, B6, and B8 may display an image having normal luminance, whereas the first, third, fifth, and seventh blue pixels B1, B3, B5, and B7 may display an image having abnormal luminance.

Figure 8:
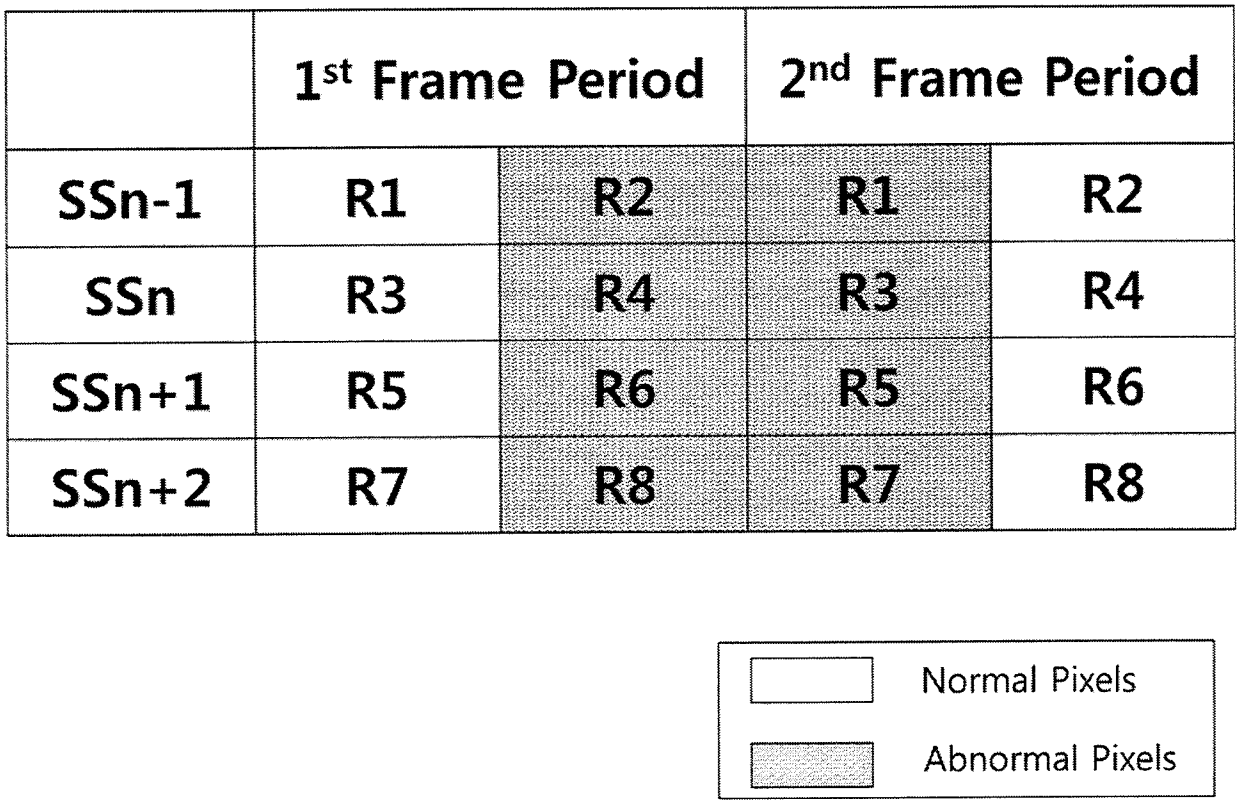
FIG. 8 illustrates examples of normal pixels and abnormal pixels.

FIG. 8 is a chart illustrating examples of normal pixels and abnormal pixels categorized based on an input order of the control signals corresponding to the respective frame periods in FIGS. 6A and 6B, Referring to FIG. 8, during the first frame period, the first, third, fifth, and seventh red pixels R1, R3, R5, and R7 may normally display images, while the second, fourth, sixth, and eighth red pixels R2, R4, R6 and R8 may abnormally display images. In contrast, during the second frame period, the second, fourth, sixth, and eighth red pixels R2, R4, R6 and R8 may normally display images, while the first, third, fifth, and seventh red pixels R1, R3, R5, and R7 may abnormally display images.

Thus, according to the first embodiment, the input order of the control signals CS1 and CS2 is changed corresponding to the respective frame periods. As a result, an image incorrectly displayed during the odd-numbered frame periods may be correctly displayed during the even-numbered frame periods. In contrast, an image incorrectly displayed during the even-numbered frame periods may be correctly displayed during the odds-numbered frame periods. As a result, luminance deviation between images displayed during a plurality of frame periods may be reduced, thereby preventing image quality deterioration.

When the control signals CS1 and CS2 are supplied in an input order as illustrated in FIGS. 6A and 6B, a vertical strap pattern may appear on the screen. In order to avoid this phenomenon, the control signals CS1 and CS2 may be applied based on the method described below with reference to FIGS. 9A and 9B.

Figure 9A:
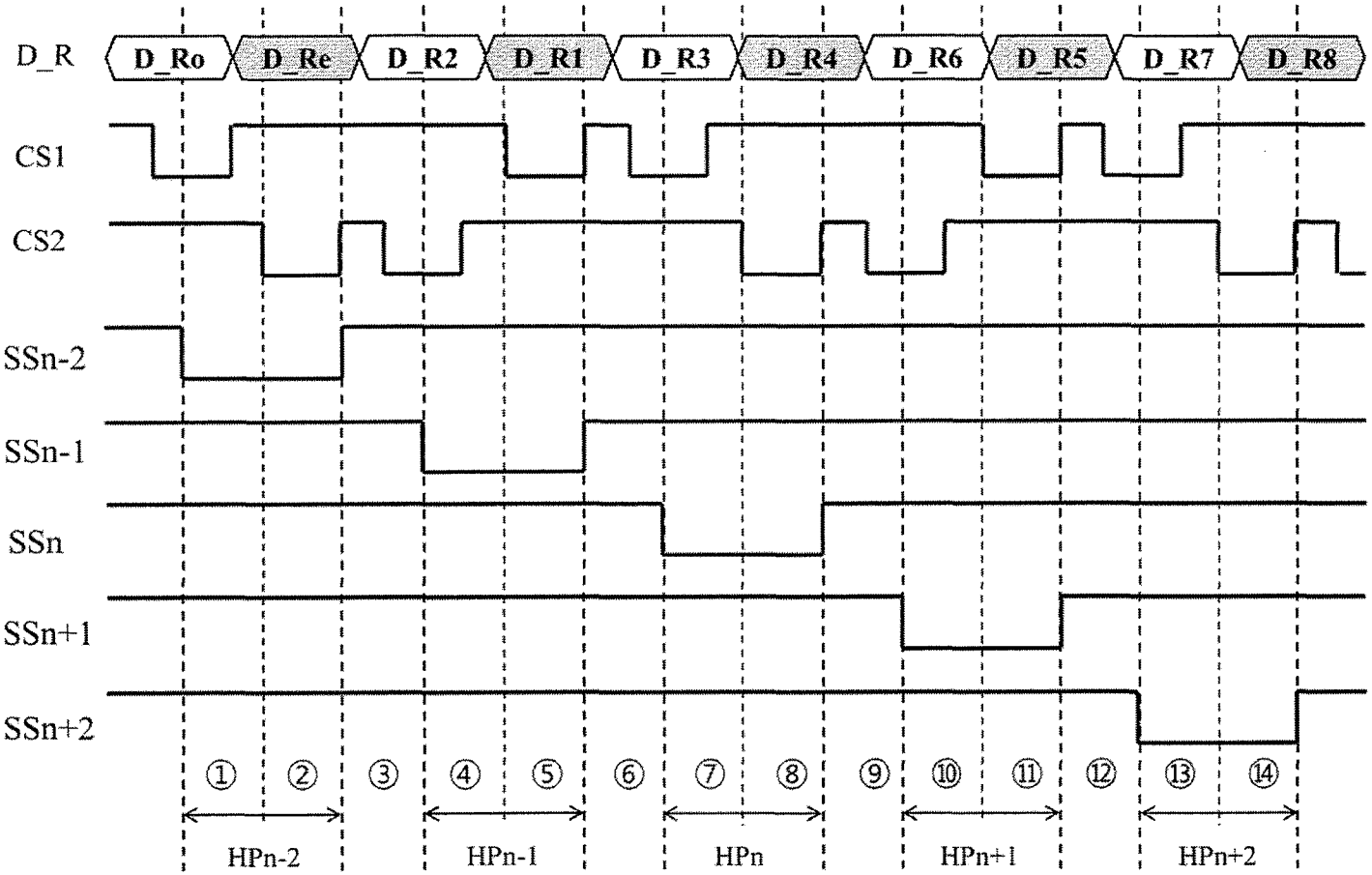
FIG. 9A illustrates red image data signals, control signals, and scan signals applied during a first frame period of a second embodiment.
Figure 9B:
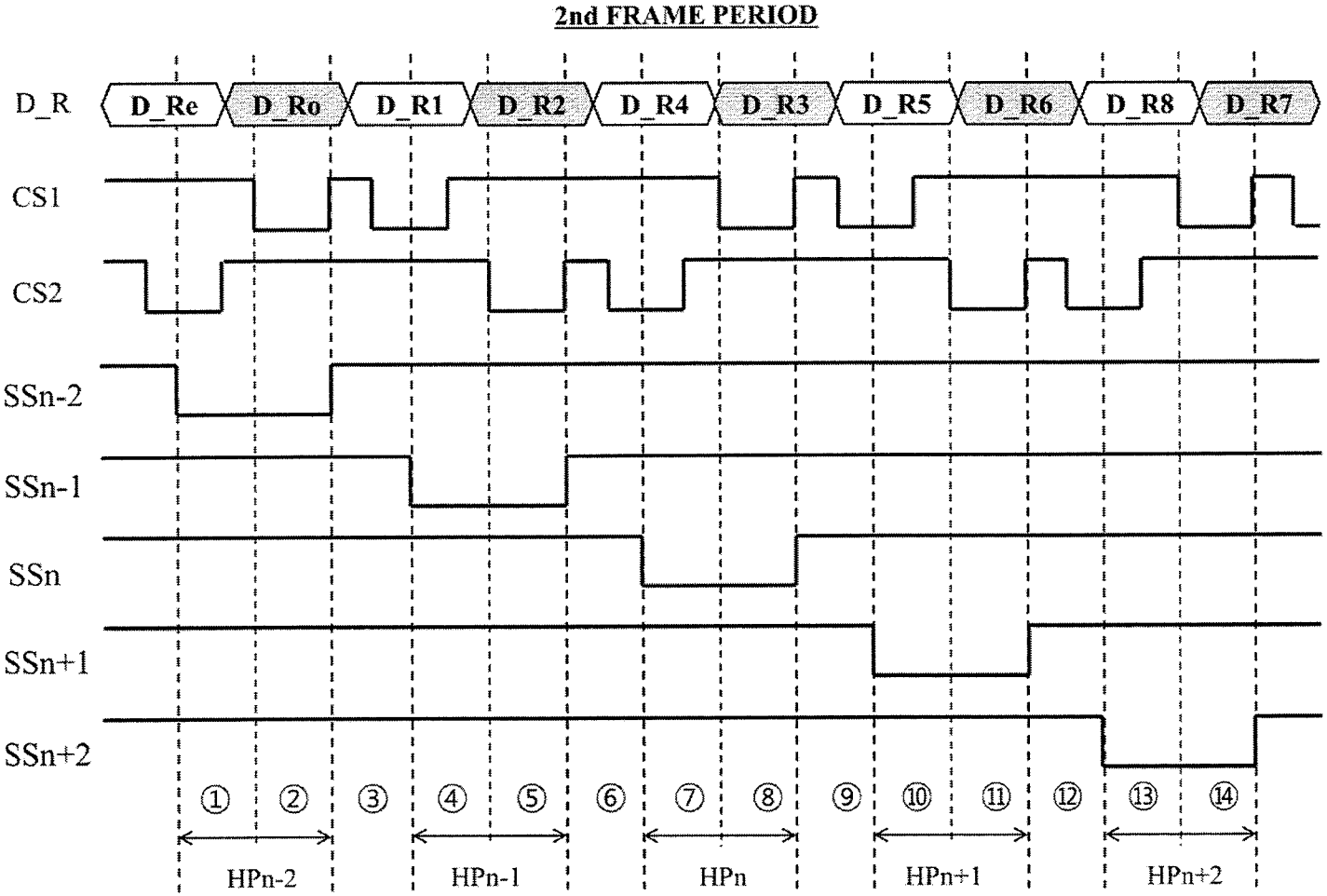
FIG. 9B illustrates red image data signals, control signals, and scan signals applied during a second frame period of the second embodiment.

FIG. 9A is a timing diagram illustrating examples of red image data signals, control signals, and scan signals applied during a first frame period according to a second embodiment. FIG. 9B is a timing diagram illustrating examples of red image data signals, control signals, and scan signals applied during a second frame period according to the second embodiment.

As illustrated in FIGS. 9A and 9B, an input order of the control signals CS1 and CS2 applied to the demultiplexer D-MUX during the first frame period is different from an input order of the control signals CS1 and CS2 applied to the demultiplexer D-MUX during the second frame period. For example, the input order of the control signals CS1 and CS2 during the second frame period may be in reverse order of the input order of the control signals CS1 and CS2 during the first frame period.

In one embodiment, the first control signal CS1 may be output before the second control signal CS2 is output during the first frame period, whereas the second control signal CS2 may be output before the first control signal CS1 is output during the second frame period. In other words, as illustrated in FIGS. 9*a* and 9*b*, the respective first and second frame periods include the plurality of horizontal periods, and the input orders of the control signals CS1 and CS2 during the corresponding horizontal periods in different frame periods are different from each other.

For example, during the nth horizontal period HPn in the first frame period in FIG. 9A, the first control signal CS1 is output during the first half ⑦ of the horizontal period HPn, and the second control signal CS2 is output during the second half ⑧ of the horizontal period HPn. In contrast, during the nth horizontal period HPn in the second frame period in FIG. 9B, the second control signal CS2 is output during the first half ⑦ of the horizontal period HPn, and the first control signal CS1 is output during the second half ⑧ of the horizontal period HPn.

Further, the input orders of the control signals CS1 and CS2 applied to the demultiplexer during one frame period are different from each other corresponding to the respective horizontal periods. For example, as illustrated in FIG. 9A, an input order of the control signals CS1 and CS2 during the nth horizontal period HPn in the first frame period may be in reverse order of an order of the control signals CS1 and CS2 during the n−1th horizontal period HPn−1 in the first frame period.

Also, according to one example, during the n−1th horizontal period HPn−1 in the first frame period illustrated in FIG. 9A, the second control signal CS2 is output during the first half ⑦ of the horizontal period HPn, and the first control signal CS1 is output during the second half ⑧ of the horizontal period HPn. In contrast, during the nth horizontal period HPn in the first frame period in FIG. 9A, the second control signal CS2 is output during the first half ⑦ of the horizontal period HPn, and the first control signal CS1 is output during the second half ⑧ of the horizontal period HPn.

Further, the input order of the image data signal applied to the demultiplexer D-MUX is changed according to the above-described input order of the control signals. For example, an input order of the image data signals applied to the demultiplexer D-MUX during the first frame period is in reverse order of an input order of the image data signals applied to the demultiplexer D-MUX during the second frame period.

In one embodiment, during the nth horizontal period HPn in the first frame period in FIG. 9A, the third red image data signal D_R3 is output during the first half ⑦ of the horizontal period HPn, and the fourth red image data signal D_R4 is output during the second half ⑧ of the horizontal period HPn. In contrast, during the nth horizontal period HPn in the second frame period, the fourth red image data signal D_R4 is output during the first half ⑦ of the horizontal period HPn, and the third red image data signal D_R3 is output during the second half ⑧ of the horizontal period HPn.

Further, the input order of the image data signals supplied to the demultiplexer corresponding to the respective horizontal periods during one frame period are different from each other. For example, as illustrated in FIG. 9A, an input order of the red image data signals during the nth horizontal period HPn in the first frame period may be in reverse order of an input order of the red image data signals during the n−1th horizontal period HPn−1 in the first frame period.

For example, during the n−1th horizontal period HPn−1 in the first frame period in FIG. 9A, the second red image data signal D_R2 corresponding to the fourth data line DL4 is output during the first half ⑦ of the horizontal period HPn, while the first red image data signal D_R1 corresponding to the first data line DL1 is output during the second half ⑧ of the horizontal period HPn. In contrast, during the nth horizontal period HPn in the first frame period in FIG. 9A, the third red image data signal D_R3 corresponding to the first data line DL1 is output during the first half ⑦ of the horizontal period HPn, while the fourth red image data signal D_R4 corresponding to the fourth data line DL4 is output during the second half ⑧ of the horizontal period HPn.

According to a second embodiment, the control signals CS1 and CS2 may be selectively output in the order of FIGS. 9A and 9B during only a predetermined number of frame periods. Further, according to one embodiment, the first and the second control signals CS1 and CS2 may be applied to the demultiplexer D-MUX in the order of FIG. 9A every odd-numbered frame period. Further, the first and the second control signals CS1 and CS2 may be applied to the demultiplexer D-MUX in the order of FIG. 9B every even-numbered frame period.

Further, according to the second embodiment, the control signals CS1 and CS2 may be selectively output in the order of FIGS. 9A and 9B during only a predetermined number of horizontal periods. Further, according to one embodiment, the first and the second control signals CS1 and CS2 may be applied to the demultiplexer D-MUX in the order of FIG. 9A every odd-numbered horizontal period. Further, the first and the second control signals CS1 and CS2 may be applied to the demultiplexer D-MUX in the order of FIG. 9B every even-numbered horizontal period.

Accordingly, during the first frame period, the second, third, sixth, and seventh red pixels R2, R3, R6, and R7, which may receive the correct image data signals right after initiation due to the first control signal CS1 that is output relatively early, may display an image having normal luminance, whereas the first, fourth, fifth, and eighth red pixels R1, R4, R5, and R8, which receive image data signals of other pixels prior to the correct image data signals after initiation, may display an image having abnormal luminance.

Likewise, during the first frame period, the second, third, sixth, and seventh green pixels G2, G3, G6, and G7 may display an image having normal luminance, while the first, fourth, fifth, and eighth green pixels G1, G4, G5, and G8 may display an image having abnormal luminance.

Likewise, during the first frame period, the second, third, sixth, and seventh blue pixels B2, B3, B6, and B7 may display an image having normal luminance, while the first, fourth, fifth, and eighth blue pixels B1, B4, B5, and B8 may display an image having abnormal luminance.

During the second frame period, an input order of the first and the second control signals CS1 and CS2 is reversed. Thus, during the second frame period, the first, fourth, fifth, eighth red pixels R1, R4, R5, and R8, which may receive the correct image data signals right after initiation due to the second control signal CS2 that is output relatively early, may display an image having normal luminance, whereas the second, third, sixth, seventh red pixels R2, R3, R6, and R7, which receive image data signals of other pixels prior to the correct image data signals after initiation, may display an image having abnormal luminance.

Likewise, during the second frame period, the first, fourth, fifth, eighth green pixels G1, G4, R5, and G8 may display an image having normal luminance, while the second, third, sixth, and seventh green pixels G2, G3, G6, and G7 may display an image having abnormal luminance.

Likewise, during the second frame period, the first, fourth, fifth, and eighth blue pixels B1, B4, B5, and B8 may display an image having normal luminance, while the second, the third, sixth, and seventh blue pixels B2, B3, B6, and B7 may display an image having abnormal luminance.

Figure 10:
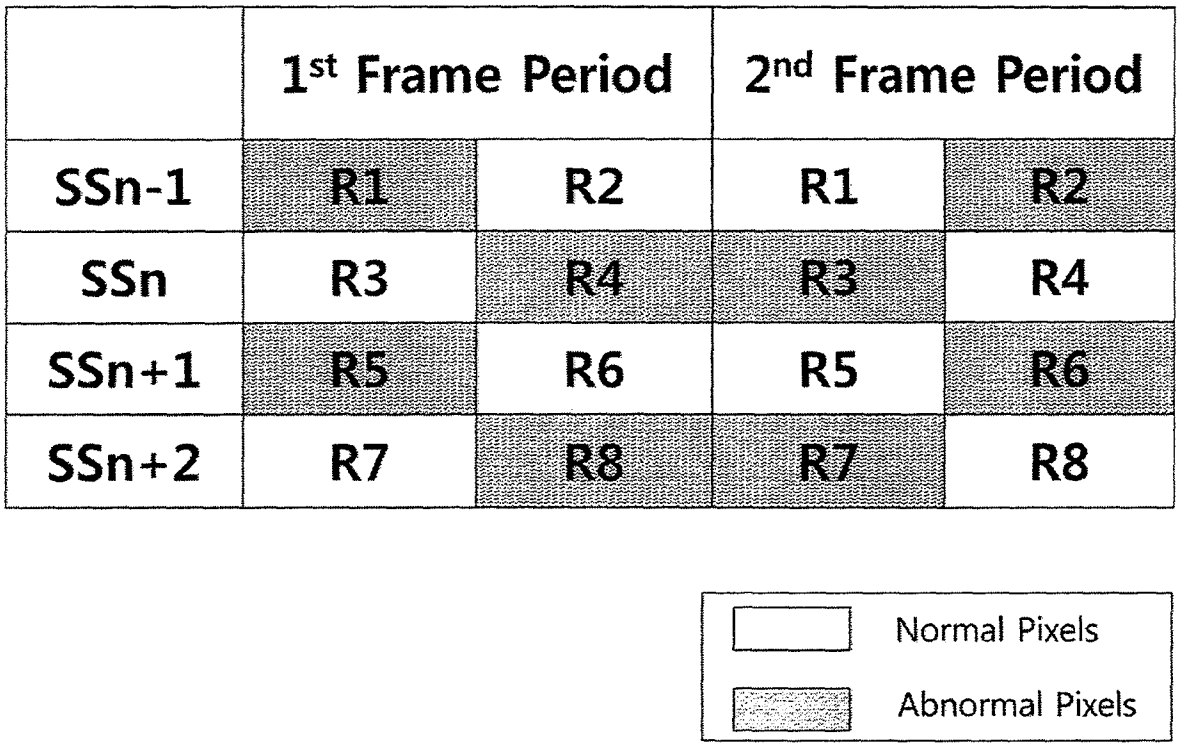
FIG. 10 illustrates examples of normal pixels and abnormal pixels.

FIG. 10 is a chart illustrating examples of normal pixels and abnormal pixels categorized based on an input order of the control signals corresponding to the respective frame periods in FIGS. 9A and 9B.

Referring to FIG. 10, during the first frame period, the second, third, sixth, and seventh red pixels R2, R3, R6, and R7 may normally display an image, whereas the first, fourth, fifth, and eighth red pixels R1, R4, R5, and R8 may abnormally display an image. In contrast, during the second frame period, the first, fourth, fifth, and eighth red pixels R1, R4, R5, and R8 may normally display an image, while the second, third, sixth, and seventh red pixels R2, R3, R6, and R7 may abnormally display an image Thus, according to the second embodiment, the input order of the control signals CS1 and CS2 is changed corresponding to the respective frame periods. As a result, an image incorrectly displayed during the odd-numbered frame periods may correctly displayed during the even-numbered frame periods. In contrast, an image incorrectly displayed during the even-numbered frame periods may be correctly displayed during the odds-numbered frame periods.

Further, the input order of the control signals CS1 and CS2 is also changed corresponding to the respective horizontal lines, such that a vertical strap pattern may not appear. As a result, luminance deviation between images displayed over a plurality of frame periods may be reduced, thereby preventing image quality deterioration.

Figure 11A:
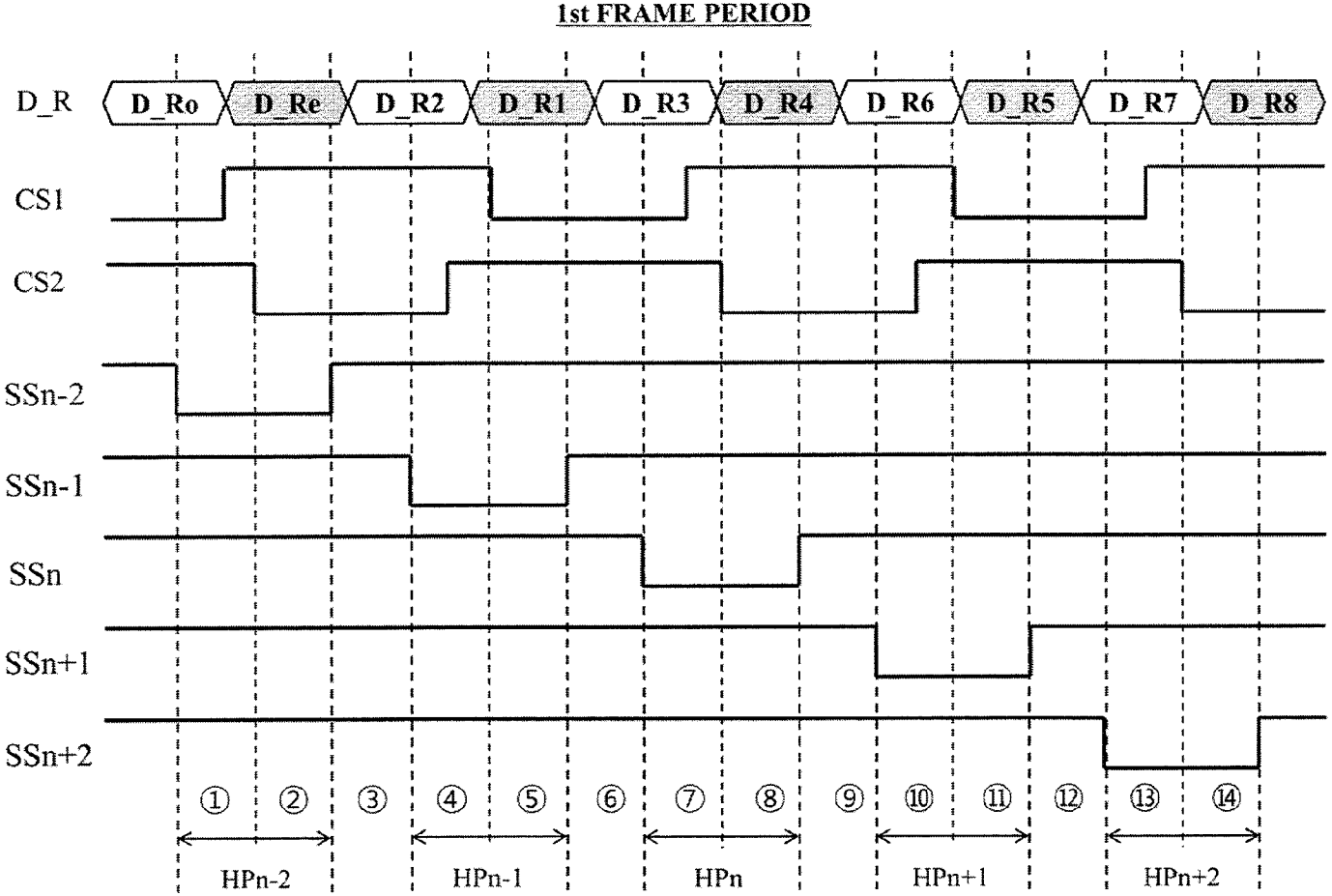
FIG. 11A illustrates red image data signals, control signals, and scan signals applied during a first frame period of a third embodiment.
Figure 11B:
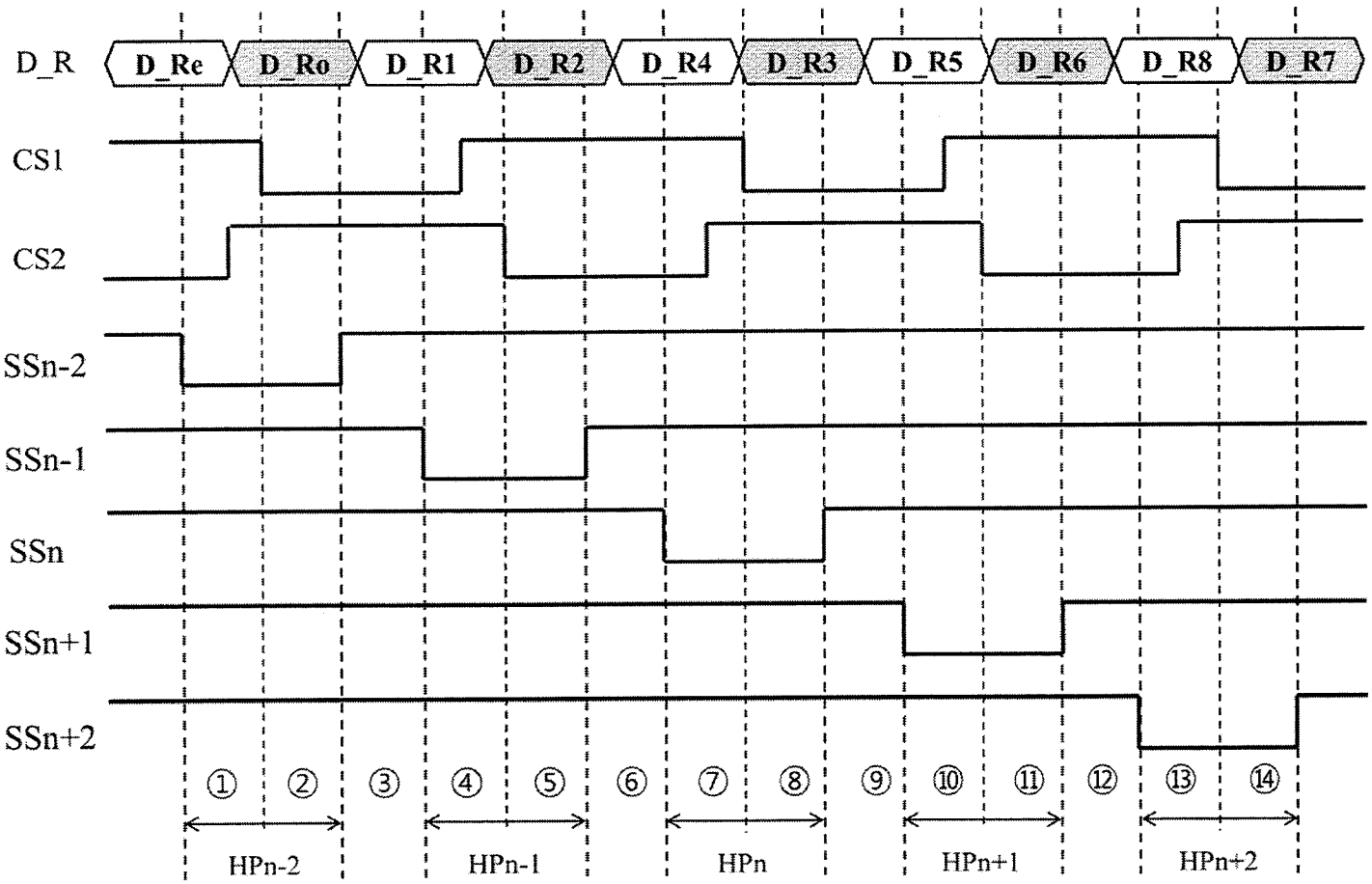
FIG. 11B illustrates red image data signals, control signals, and scan signals applied during a second frame period according of the third embodiment.

FIG. 11A is a timing diagram illustrating examples of red image data signals, control signals, and scan signals applied during the first frame period according to a third embodiment. FIG. 11B is a timing diagram illustrating examples of red image data signals, control signals, and scan signals applied during the second frame period according to the third embodiment.

The control signals in FIG. 11A are a modified embodiment of the control signals in FIG. 9A. Herein, the two control signals CS1 and CS2 which are supplied to the same control line and disposed temporally adjacent to each other, among the control signals in FIG. 9A, may be output in a continuous form.

For example, the second control signal CS2 output relatively late during the nth horizontal period HPn and the second control signal CS2 output relatively early during the n+1th horizontal period HPn+1 of FIG. 9A may be changed into a single signal, as illustrated in FIG. 11A. For example, a high level exhibited in ninth period ⑨ of FIG. 9A may be changed into a low level. In this case, the number of transition of the control signals CS1 and CS2 is reduced, thereby reducing power consumption.

According to one embodiment, the display device may further include a data modulator DM. The data modulator DM may compensate for the image data signals D_RGB supplied from the system SYS. The compensated image data signals D_RGB may be supplied to the data driver DD. For example, the data modulator DM may compensate for at least one image data signal by adding a predetermined compensation value to or subtracting a predetermined compensation value from the corresponding image data D_RGB.

Further, the data modulator DM may compensate for the corresponding image data signal by modulating a gamma voltage GMA generated from the power supplier PS, instead of correcting the image data signal supplied from the system.

Further, the data modulator DM may compensate for the corresponding image data signal by modulating gray-level voltage values generated from a gamma string installed inside the data driver DD, instead of correcting the gamma voltage GMA. The gamma string produces the gray-level voltage by dividing gamma voltages.

The data driver DD may include the data modulator DM. In this case, the data modulator DM compares the correct image data signal with the incorrect image data signal, and determines a modulation of the correct image data signal based on the comparison result. For example, when the correct image data signal is larger than the incorrect image data signal, the data modulator DM may add a predetermined compensation value to the correct image data signal. When the correct image data signal is the same as or smaller than the incorrect image data signal, the data modulator DM may add a predetermined compensation value to the correct image data signal.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a display panel;

a plurality of pixel columns including a plurality of pixels on the display panel, each pixel column of the plurality of pixel columns including at least one pixel;

a plurality of scan lines coupled to the plurality of pixels;

a plurality of data lines coupled to the plurality of pixels;

a demultiplexer to timely output image data signals, based on control signals, to the plurality of data lines; and a data driver including a plurality of output channels to supply the image data signals to the demultiplexer, each output channel of the plurality of output channels coupled to pixels in different columns of the plurality of pixel columns that are to emit a same color of light, wherein the demultiplexer, during a first frame period, is to supply a first image data signal to a first pixel column of the plurality of pixel columns and then supply a second image data signal to a second pixel column of the plurality of pixel columns after a predetermined time elapses, and during a second frame period is to supply a third image data signal to the second pixel column of the plurality of pixel columns and then supply a fourth image data signal to the first pixel column of the plurality of pixel columns after a predetermined time elapses, wherein the first image data signal among the first image data signal and the fourth image data signal is a correct image data signal corresponding to the first pixel column of the plurality of pixel columns, wherein the third image data signal among the second image data signal and the third image data signal is a correct image data signal corresponding to the second pixel column of the plurality of pixel columns.

2. The display device as claimed in claim 1, further comprising: a controller to supply the control signals which determine an order of driving the plurality of pixel columns.

3. The display device as claimed in claim 2, wherein the controller is to change the control signals with respect to the first frame period and the second frame period.

4. The display device as claimed in claim 1, wherein the demultiplexer is to timely output the image data signals and is to supply the image data signals to data lines connected to pixels of a same color.

5. The display device as claimed in claim 1, wherein:

the first frame period is a 2p−1th frame period, the second frame period is a 2pth frame period, and p is a natural number greater than or equal to 1.

6. The display device as claimed in claim 1, wherein:

the first frame period includes at least two horizontal periods; and the demultiplexer, during a first horizontal period of the at least two horizontal periods, is to supply the first image data signal to a pixel of the first pixel column and then supply the second image data signal to a pixel of the second pixel column after a predetermined time elapses, and during a second horizontal period of the at least two horizontal periods is to supply the third image data signal to the pixel of the second pixel column and then supply the fourth image data signal to the pixel of the first pixel column after a predetermined time elapses.

7. The display device as claimed in claim 6, wherein:

the first horizontal period is a 2q−1th horizontal period, the second horizontal period is a 2qth horizontal period, and q is a natural number greater than or equal to 1.

8. The display device as claimed in claim 7, wherein a control signal output last during the 2q−1th horizontal period is continuous with a control signal output first during the 2qth horizontal period.

9. The display device as claimed in claim 1, further comprising:

a data modulator to compensate for the first image data signal, the second image data signal, the third image data signal, and the fourth image data signal and to output compensated image data signals.

10. The display device as claimed in claim 1, wherein each pixel of the plurality of pixels includes:

a light emitter;

a driving switch to be controlled by a signal of a first node and connected between a second node and a third node;

an initiating switch to be controlled by an n−1th scan signal supplied from an n−1th scan line and connected between the first node and an initiating power line;

a compensating switch to be controlled by an nth scan signal supplied from an nth scan line and connected between the first node and the third node;

a data switch to be controlled by the nth scan signal supplied from the nth scan line and connected between a corresponding data line and the second node;

a static power switch to be controlled by an nth light-emission signal supplied from an nth light-emission line and connected between the second node and a first driving power line;

a light-emission control switch to be controlled by the nth light-emission signal supplied from the nth light-emission line and connected between the third node and the light emitter; and a capacitor connected between the first driving power line and the first node, wherein n is a natural number greater than or equal to 1.

11. The display device as claimed in claim 1, wherein the demultiplexer is to:

during the first frame period, simultaneously supply the image data signals to a first set of three pixel columns including the first pixel column and then simultaneously supply the image data signals to a second set of three pixel columns including the second pixel column after a predetermined time elapses, and during the second frame period, simultaneously supply the image data signals to the second set of three pixel columns and then simultaneously supply the image data signals to the first set of three pixel columns after a predetermined time elapses.

12. A method for driving a display device, the method comprising:

receiving image data signals from a plurality of output channels of a data driver, each output channel of the plurality of output channels coupled to pixels in different columns of a plurality of pixel columns that are to emit a same color of light;

during a first frame period, supplying a first image data signal to a first pixel column of the plurality of pixel columns, and then supplying a second image data signal to a second pixel column of the plurality of pixel columns after a predetermined time elapses, through a demultiplexer; and during a second frame period, supplying a third image data signal to the second pixel column of the plurality of pixel columns, and then supplying a fourth image data signal to the first pixel column of the plurality of pixel columns after a predetermined time elapses, through the demultiplexer, wherein the first image data signal among the first image data signal and the fourth image data signal is a correct image data signal corresponding to the first pixel column of the plurality of pixel columns, wherein the third image data signal among the second image data signal and the third image data signal is a correct image data signal corresponding to the second pixel column of the plurality of pixel columns.

13. The method as claimed in claim 12, further comprising:

supplying control signals which determine an order of driving the plurality of pixel columns including the first pixel column and the second pixel column to the demultiplexer.

14. The method as claimed in claim 12, further comprising:

changing control signals for the first frame period and the second frame period.

15. The method as claimed in claim 12, wherein:

the first frame period is a 2p−1th frame period, the second frame period is a 2pth frame period, and p is a natural number greater than or equal to 1.

16. The method as claimed in claim 12, wherein:

the first period includes at least two horizontal periods, and during a first horizontal period of the at least two horizontal periods, supplying the first image data signal to the first pixel column of the plurality of pixel columns and then supplying the second image data signal to the second pixel column of the plurality of pixel columns after a predetermined time elapses.

17. The method as claimed in claim 16, wherein, during a second horizontal period of the at least two horizontal periods, supplying the third image data signal to the second pixel column of the plurality of pixel columns and then supplying the fourth image data signal to the first pixel column of the plurality of pixel columns after a predetermined time elapses.

18. The method as claimed in claim 17, wherein:

the first horizontal period is a 2q−1th horizontal period, the second horizontal period is a 2qth horizontal period, and q is a natural number greater than or equal to 1.

19. The method as claimed in claim 12, further comprising:

compensating for the first image data signal, the second image data signal, the third image data signal, and the fourth image data signal, and outputting compensated image data signals.

* * * * *